United States Patent [19]

Svedberg et al.

[11] Patent Number: 4,836,849

[45] Date of Patent: Jun. 6, 1989

[54] OXIDATION RESISTANT NIOBIUM ALLOY

[75] Inventors: Robert C. Svedberg, Elizabeth Twp., Allegheny County; Robert L. Ammon, Baldwin Boro, both of Pa.

[73] Assignee: Westinghouse Electric Corp., Pittsburgh, Pa.

[21] Appl. No.: 44,256

[22] Filed: Apr. 30, 1987

[51] Int. Cl.[4] ..... C22C 27/02

[52] U.S. Cl. ..... 75/245; 419/23; 419/32

[58] Field of Search ..... 75/245; 419/23, 32

[56] References Cited

U.S. PATENT DOCUMENTS

| | | | |
|---|---|---|---|
| 3,038,798 | 6/1962 | Berger et al. . | |
| 3,127,286 | 3/1964 | Henderson et al. . | |
| 3,152,891 | 10/1964 | Begley . | |
| 3,172,196 | 3/1965 | Beaver et al. | 75/245 |
| 3,231,344 | 1/1966 | Beaver et al. | 75/245 |
| 3,281,736 | 10/1966 | Kunzler et al. . | |
| 3,341,307 | 9/1967 | Tarr et al. | 75/245 |
| 3,469,976 | 9/1969 | Iler . | |
| 3,551,946 | 1/1971 | Backer et al. . | |
| 3,577,635 | 4/1971 | Bergman et al. . | |
| 3,607,251 | 9/1971 | Ostermann . | |
| 3,639,180 | 2/1972 | Kelcher . | |
| 3,682,626 | 8/1972 | Begley et al. . | |
| 3,723,092 | 3/1973 | Benjamin . | |
| 3,723,104 | 3/1973 | Rudy . | |
| 3,752,665 | 8/1973 | Roy et al. . | |
| 3,926,568 | 12/1975 | Benjamin et al. . | |
| 4,059,441 | 11/1977 | Ray et al. . | |
| 4,070,184 | 1/1978 | Scheihauer et al. . | |
| 4,084,965 | 4/1972 | Fry | 75/245 |
| 4,110,131 | 8/1978 | Gessinger . | |
| 4,414,029 | 11/1983 | Newman et al. . | |
| 4,417,922 | 11/1983 | Hall et al. . | |
| 4,443,249 | 4/1984 | Weber et al. . | |
| 4,592,781 | 6/1986 | Cheney et al. | 75/245 |

*Primary Examiner*—Stephen J. Lechert, Jr.
*Assistant Examiner*—Eric Jorgensen
*Attorney, Agent, or Firm*—Daniel P. Cillo

[57] ABSTRACT

Disclosed is a mixture of about 55% to about 90% by volume powdered niobium alloy and about 10% to about 45% by volume powdered intermetallic compound selected from the group consisting of $NbAl_3$, $NbFe_2$, $NbCo_2$, $NbCr_2$, and mixtures thereof. The mixture is mechanically alloyed to intermix the intermetallic compound with the particles of the niobium alloy. A shape is made by consolidating the mechanically alloyed powder.

4 Claims, No Drawings

OXIDATION RESISTANT NIOBIUM ALLOY

The government of the United States of America has rights in this invention under Contract No. N00019-82-C-0384 with the Department of Defense.

BACKGROUND OF THE INVENTION

Niobium alloys that have high strength at high temperatures do not resist oxidation well. These alloys rapidly oxidize, resulting in the recession of the metal and the ultimate failure of the alloy as a structural part. While oxidation resistant niobium alloys have been made, such alloys do not have high strength at high temperatures. Attempts have been made to solve this problem by coating parts made with high strength niobium alloys with an oxidation resistant alloy. However, once the coating has cracked, abraded, or otherwise been penetrated, catastrophic failure of the underlying niobium alloy can occur.

SUMMARY OF THE INVENTION

We have discovered that it is possible to make a shape from a niobium alloy which can withstand oxidation at high temperatures and still exhibit high strength. We were able to accomplish this by mechanically alloying a powdered niobium alloy with powdered intermetallic compounds, intimately mixing the components together and altering the particle size distribution, and then forming the shape from the intimately mixed particles. That the resulting shape still displays high strength at high temperatures is surprising since some of the niobium alloy particles that form the shape are now separated from each other by a mixture of the intermetallic particles. Nevertheless, shapes formed from the mechanically alloyed particles prepared according to this invention display both high strength and oxidation resistance at high temperatures which, until now, has not been achieved.

DESCRIPTION OF THE INVENTION

Any powdered niobium alloy can be used in this invention. Particularly applicable are those niobium alloys that are used for commercial structures, especially structures that are exposed to high temperatures and require high strength, as it is in those applications that the benefits of this invention are the greatest. The following table gives some examples of niobium alloys and their properties.

| Classification | Developer | Designation | Composition (Wt %) | Density (g/cc)/lbs/in |
|---|---|---|---|---|
| Group 1 | | | | |
| High Strength | General Electric | Cb-1 | Nb—30W—1Zr—0.06C | 10.30/0.372 |
| Low Ductility | Westinghouse | B-88 | Nb—28W—2Hf—0.067C | 10.33/0.372 |
| | Westinghouse | B-99 | Nb—22W—2Hf—0.067C | 9.85/0.356 |
| | Pratt & Whitney | Cb-132M | Nb—15W—5Mo—20Ta—25Zr—0.13C | 10.66/0.385 |
| | General Electric | AS30 | Nb—20W—12Zr—0.1C | 9.60/0.347 |
| | General Electric | F-48 | Nb—15W—5Mo—1Zr—0.1C | 9.41/0.34060 |
| | Imperial Metal | SU31 | Nb—17W—3.5Hf—0.1C | 9.55/0.345 |
| Group II | | | | |
| Moderate Strength | Imperial Metal | SU16 | Nb—11W—3Mo—1Hf—0.08C | 9.27/0.335 |
| Moderate Ductility | Fansteel | FS85 | Nb—10W—28Ta—1Zr | 10.60/0.383 |
| | DuPont | D-43 | Nb—10W—1Zr—0.1C | 9.02/0.326 |
| | Union Carbide | Cb-752 | Nb—10W—2.5Zr | 9.02/0.326 |
| | Fansteel | SCb-291 | Nb—10W—10Ta | 9.60/0.347 |
| | Wah Chang | C129-)Y | Nb—10W—10Hf—0.2Y | 9.49/0.343 |
| | Westinghouse | B-66 | Nb—5Mo—5Y—1Zr | 8.44/0.305 |
| | General Electric | AS55 | Nb—5W—1Zr—0.2Y | 8.77/0.317 |
| | Pratt & Whitney | PWC-11 | Nb—1Zr—0.1C | 8.58/0.310 |
| Group III | | | | |
| Low Strength | Union Carbide | CB-753 | Nb—5V—1.25Zr | 8.39/0.303 |
| High Ductility | Wah Chang | C103 | Nb—10Hf—0.7Zr | 8.86/0.320 |
| | Westinghouse | B33 | Nb—5V | 8.47/0.306 |
| | DuPont | D14 | Nb—5Zr | 8.58/0.310 |
| | DuPont | D36 | Nb—5Zr—10Ti | 7.92/0.286 |
| | | Nb—1Zr | Nb—1Zr | 8.58/0.310 |

Examples of preferred structural niobium alloys include "B-88" and "Nb-1Zr." A powder of the niobium alloy can be prepared in many different ways, including, for example, rapid solidification techniques, where a rotating rod of the alloy is ablated by a plasma arc in an inert gas. Other techniques for forming the powder include melt spinning, dripping a melted alloy on a rotating disk, splat cooling, etc. The powdered niobium alloy may have any particle size desired.

The intermetallic compounds that are useful in mixing with the niobium alloy particles according to this invention include niobium aluminide ($NbAl_3$), $NbFe_2$, $NbCo_2$, and $NbCr_2$. We have found that other similar or related compounds, such as $Nb_2Al$, $Nb_3Al$, and NbNi do not form the proper oxide phases on heating to adequately protect the niobium alloy from oxidation. Of the four intermetallic compounds that may be used, $NbFe_2$ and $NbCo_2$ seem to work the best; $NbCr_2$ reduces oxidation but because chromium is volatile it cannot withstand temperatures as high as the other intermetallic compounds. Particularly preferred are mixtures of $NbAl_3$ and $NbFe_2$, $NbAl_3$ and $NbCo_2$, and $NbAl_3$ and $NbCr_2$ because, in the presence of oxygen, these compounds are believed to form a rutile oxide that has the structure $NbM'O_4$, or a gamma oxide layer having the structure $M'_2O_3$, or a spinel layer having the structure $MAl_2O_4$, where M is Fe, Co, Cr, or mixtures thereof, and M' is M or Al. These oxides are very effective in resisting the penetration of oxygen, thereby preventing oxygen from attacking the underlying niobium alloy. Of these three mixtures, the mixture of $NbAl_3$ and $NbCo_2$ is most preferred because the resulting rutile oxide has been reported to undergo no phase transformations, and therefore a coating formed of it is less likely to crack when the temperature is changed. While mixtures of the intermetallic compounds can be formed in any ratio, a preferred ratio of the mixtures with $NbAl_3$ is about a 1:1 to about a 3:1 volume ratio of $NbAl_3$ to $NbM_2$ because more aluminum may reduce the mechanical stability of the resulting shape and less aluminum may reduce its oxidation resistance. The powdered intermetallic compound can be made in a variety of ways. It is typically made by melting a mixture of the component elements and pulverizing the resulting ingot. The particle size of the intermetallic compound is preferably the same or smaller than the particle size of the niobium alloy as that facilitates the mixing of the particles of the niobium alloy with the particles of the intermetallic compound.

In the first step of the process of this invention, a mixture is formed of about 55% to about 90% by volume of the powdered niobium alloy and about 10% to about 45% by volume of the powdered intermetallic compound. If less intermetallic compound is used in the mixture the resulting shape will be more susceptible to oxidation, and more intermetallic compound may make the shape more brittle.

In the next step of the process of this invention, the mixture of the powdered niobium alloy and the powdered intermetallic compound is mechanically alloyed. Mechanical alloying is a process that mechanically mixes the intermetallic particles and the niobium alloy particles. Mechanical alloying can be accomplished in a variety of ways, including using a ball mill or an attritor, techniques well-known in the art.

Finally, the mechanically alloyed mixture is consolidated to form a shape, using any powder metallurgical consolidation technique. Examples of such techniques including hot isostatic pressing (HIPing), explosive bonding, cold pressing and sintering, hot pressing, hot rolling, and hot extruding. For additional protection against oxidation, the shape can be coated with an oxidation resistant coating such as, for example, silicides containing Cr, Ti, Al, and/or B; aluminides containing Cr, FeB, $SiO_2$, Fe, Ni, and/or Si; or noble metal coatings containing Pt, Rh, Hf, and/or Ir. The resulting shape can be coated after fabrication or machining, as desired, to final tolerances.

The shape is particularly useful for applications that require high strength at high temperatures in the presence of oxygen such as, for example, the combustors, turbine blades, and nozzles of jet engines.

The following examples further illustrate this invention.

EXAMPLE

The powdered niobium alloy, "B-88," was prepared from a 2.5 inch diameter ingot, which was made by vacuum arc-melting an electrode composed of niobium plate, tungsten sheets, hafnium foil, and carbon cloth threads. The ingot was converted in to a spherical powder by rotating the ingot at 15,000 rpm while heating one end with a plasma in an inert gas atmosphere. Material melted by the plasma was flung off the ingot, forming spherical particles as it cooled during flight. The following table gives the particles size distribution of the resulting powder.

| Sieve Size (U.S. Series) | 35 | 45 | 60 | 80 | 120 | 170 | 230 |
|---|---|---|---|---|---|---|---|
| Particle Size (μm) | 500 | 354 | 250 | 177 | 125 | 88 | 63 |
| Percent on Screen | 0.1 | 3.6 | 18.2 | 24.6 | 24.2 | 15.8 | 8.2 |
| Percent Finer Than | 99.9 | 96.3 | 78.1 | 53.5 | 29.3 | 13.5 | 5.3 |

-continued

| Sieve Size (U.S. Series) | 35 | 45 | 60 | 80 | 120 | 170 | 230 |
|---|---|---|---|---|---|---|---|
| This Size | | | | | | | |

Three intermetallic compounds, $NbAl_3$, $NbFe_2$, and $NbCo_2$ were produced by non-consumably arc-melting large buttons of the appropriate composition. The buttons were converted into a powder by crushing and passing through a series of screens, 35 to 325 mesh.

Two powder mixtures were prepared, the first containing 80 volume percent of the "B-88" alloy and 20 volume percent of $NbAl_3$-$NbFe_2$ in a 2:1 volume ratio, and the second containing 65 volume percent of the "B-88" alloy and 35 volume percent of $NbAl_3$-$NbFe_2$ in a 2:1 volume ratio. The two powder mixtures were mechanically alloyed in a stainless steel ball mill using ½ inch nominal stainless steel balls an argon atmosphere. The milled powders had the following particle size distribution:

| Sieve Size | % of Powder Retained on the Sleeve |
|---|---|
| +270 | 34 |
| +325 | 15 |
| +400 | 7 |
| −400 | 44 |

A scanning electron photomicrograph of the powders after milling showed that the mechanical alloying caused the intermetallics to intimately mix with the "B-88" alloy particles, and to fragment and imbed on the surface of the "B-88" alloy particles.

(Attempts to consolidate the alloyed powder by explosive bonding were not successful; however, additional experimentation with explosive bonding techniques may Powders that were not mechanically alloyed and that were consolidated using hot isostatic pressing produced shapes that were unable to resist oxidation at 1000° C. Powders that were mechanically alloyed and were hot isostatically pressed at a temperature of 1200° C. and pressure of 30,000 psi for 30 minutes, however, showed no internal oxidation at 1000° C., 1175° C., and 1275° C. after 14.7, 15.3, and 21.6 hours, respectively, at each temperature with no cooling to room temperature in between. The microstructure of the shape showed no indication of internal oxidation, no penetration of the oxygen into the alloy structure, and no degradation of mechanical properties. The metal recession ranged from 13 to 18 mils per 100 hours at 1175° and 1275° C., respectively, for the alloy with 35 volume percent intermetallics. An identical "B-88" alloy with no intermetallics present had a recession rate of greater than 50 mils per 100 hours at 1175 and 1275° C.

We claim:

1. A mechanically alloyed powder consisting essentially of about 55% to about 90% by volume of niobium alloy, and about 10% to about 45% by volume of intermetallic compound selected from the group consisting of $NbAl_3$, $NbFe_2$, $NbCO_2$, $NbCr_2$, and mixtures thereof, where niobium alloy particles have intermetallic compound embedded on their surface.

2. A shape made by consolidating a mechanically alloyed powder according to claim 1.

3. A shape according to claim 2 coated with an oxidation resistant coating.

4. A mechanically alloyed powder according to claim 1 wherein said intermetallic compound is selected from the group consisting of $NbAl_3$, $NbCo_2NbCr_2$, and mixtures thereof.

* * * * *